US006155170A

United States Patent [19]

Benedetto et al.

[11] Patent Number: 6,155,170

[45] Date of Patent: Dec. 5, 2000

[54] SCREEN PRINTING MACHINE WITH ULTRAVIOLET CURING ELEMENT

[75] Inventors: John R. Benedetto; William Gillespie, Jr., both of Everett; James W. Pomeroy, Seattle; Duke Goss, Kirkland, all of Wash.

[73] Assignee: Universal Screenprinting Systems, Inc., Everett, Wash.

[21] Appl. No.: 09/232,014

[22] Filed: Jan. 14, 1999

Related U.S. Application Data

[60] Provisional application No. 60/110,823, Dec. 2, 1998, and provisional application No. 60/110,677, Dec. 2, 1998.

[51] Int. Cl.[7] ..... B41F 35/00

[52] U.S. Cl. ..... 101/424.1

[58] Field of Search ..... 101/114, 126, 101/127.1, 128, 128.1, 424.1, 487, 488

[56] References Cited

U.S. PATENT DOCUMENTS

| | | | |
|---|---|---|---|
| 1,828,771 | 10/1931 | Flockhart . | |
| 3,643,597 | 2/1972 | Lala . | |
| 3,964,385 | 6/1976 | Knight . | |
| 4,073,232 | 2/1978 | Brewer . | |
| 4,813,351 | 3/1989 | Pierson, Jr. | 101/115 |
| 4,896,597 | 1/1990 | Hayata et al. . | |
| 4,981,076 | 1/1991 | Cunill . | |
| 5,048,417 | 9/1991 | Everroad . | |
| 5,094,161 | 3/1992 | Taylor . | |
| 5,239,613 | 8/1993 | Motev et al. | 101/115 |
| 5,355,791 | 10/1994 | Benedetto et al. . | |
| 5,471,924 | 12/1995 | Helling | 101/38.1 |
| 5,544,581 | 8/1996 | Haji . | |
| 5,622,108 | 4/1997 | Benedetto et al. . | |

FOREIGN PATENT DOCUMENTS

| | | |
|---|---|---|
| 122597 | 5/1988 | Japan . |

OTHER PUBLICATIONS

Compac Systems, *RX–22 Textile Printer—The Complete Screen Printing System* Brochure.

*Primary Examiner*—Ren Yan

*Attorney, Agent, or Firm*—Christensen O'Connor Johnson Kindness PLLC

[57] ABSTRACT

A screen printing machine is provided having a cabinet, a print screen, a platen assembly, and a curing assembly. The cabinet includes an upper opening and a shelf extending inwardly along at least two opposed cabinet sidewalls. The print screen is adapted to be held on the cabinet shelf in a lateral position. The platen assembly is provided for supporting a substrate suitable for receiving a screen print. The curing assembly is movably connected to the cabinet and located generally above the cabinet upper opening. The curing assembly includes a housing having an open bottom and at least one ultraviolet bulb attached within the housing and oriented to direct ultraviolet light downward. During use, the curing assembly moves laterally between a first position in which the ultraviolet light bulb is not directly above the substrate and a second position in which the ultraviolet light bulb is located directly above the substrate.

12 Claims, 8 Drawing Sheets

SCREEN PRINTING MACHINE WITH ULTRAVIOLET CURING ELEMENT

REFERENCE TO RELATED APPLICATION

This application claims the benefit of both U.S. Provisional Application Serial No. 60/110,823 filed Dec. 2, 1998, and U.S. Provisional Application Serial No. 60/110,677 filed Dec. 2, 1998.

FIELD OF THE INVENTION

This invention relates to screen printing and, more particularly, to screen printing machines for screen printing designs on suitable substrates.

BACKGROUND OF THE INVENTION

Screen printing is an old and established way of creating designs on various substrates, such as paper, metal, wood, glass, etc. Screen printing is essentially a method of printing where a stencil is formed by a screen, the screen is used to ink a substrate, and the substrate is then allowed to dry or cure as the case may be.

Early versions of screen printing used silk stretched over a wooden frame to form the screen. A design was created by painting the screen with a greasy medium. The pores of the silk were then closed using a suitable gum. The pores of the silk in the areas covered by the greasy medium were not closed because the greasy medium rejected the gum. Thereafter, the greasy medium was washed away with a solvent, such as turpentine, if paint was used as the greasy medium, resulting in the corresponding areas becoming pervious to ink. The screen was then placed on the surface of the substrate to be decorated and ink was applied through the screen to the surface using a rubber squeegee. The ink soaked through the pervious areas of the silk and was imprinted on the substrate.

More recent versions of screen printing use fine mesh screen materials rather than silk. The chosen screen material is coated with a photographic emulsion. The photographic emulsion is exposed to a suitable source of light, with the image to be reproduced being located between the light and the emulsion. The light causes the emulsion to harden except in areas where the image is located. Thereafter, the screen is washed to remove the emulsion from the areas where it has not been hardened by the light, i.e., the image areas. The screen is then ready to be used as a stencil to print a design on a substrate.

In modern time, screen printing has been widely used to create a variety of single and multi-colored designs on a variety of items, particularly clothing, such as T-shirts and sweatshirts. A known all-in-one screen printing machine is described in U.S. Pat. No. 5,622,108 and is available for such purposes. The '108 machine includes a cabinet mounted atop a stand. The upper portion of the cabinet and one side of the cabinet are open. An ultraviolet (UV) light source is positioned on the bottom of the cabinet and is positioned to shine UV light upward. The UV light source is suitable for exposing a photographic emulsion to create an image-bearing print screen. The print screen is held in a U-shaped frame. The U-shaped frame is supported in the cabinet by a shelf that extend inwardly from the three side walls of the cabinet. The U-shaped frame is rotatably coupled to the cabinet via a downward extending leg that engages a hole located in one corner of the cabinet shelf.

The '108 machine also includes a screw adjustment assembly and a fixed bevel block that work together to register the print screen into an optimal position. To cure the applied ink, the '108 machine provides a heating element in a shallow box-like housing. The housing is rotatably connected at one comer to an upper comer of the cabinet. The heating element is positioned in the housing so that heat is directed downward from the underside of the housing. To use the '108 machine, a print screen is formed using the UV light source. A substrate is place on a horizontal platen located within the cabinet near the cabinet upper opening. The print screen is placed directly over the substrate and ink is applied across the screen. The print screen is removed and the heating element housing is laterally rotated above the cabinet upper opening where heat is directed down onto the substrate. After the ink is cured, the heating element is laterally rotated away from the upper opening of the cabinet.

Although the '108 machine is a very useful all-in-one screen printing machine, changes made to the inks available for printing have created a need for an improved machine capable of addressing the unique requirements of such inks. In particular, various types of inks are now available that are cured using high-energy ultra-violet (UV) light instead of heat. Such inks greatly reduce the negative environmental impact of the screening process and further enable ink curing to occur at much faster rates.

Screen printing processes using these new inks, are currently configured using physically separate machine components. Therefore, the worker must transfer the substrate with uncured ink from one machine to another, separate, UV curing machine. Because the UV energy is typically of the order of 100 to 400 watts per inch, these separate UV curing machines are formed such that minimal UV curing light escapes the machine. This protects the worker, but creates a disadvantage in that the substrate must be transferred from one location after inking to another location for curing. This is even more irritating when more than one color is being printed, since the substrate must be moved many times for curing each color. This can result in increased errors in positioning the screen correctly, and hence increased costs due to unusable misaligned printings.

Thus, a need exists for an all-in-one screen printing machine capable of addressing the unique requirements of UV curing inks. The ideal system would provide protection to the worker regarding harmful UV curing light and would be configured to enable the user to produce a screened substrate with as few disruptions as possible. The present invention is directed to fulfilling these and other needs.

SUMMARY OF THE INVENTION

In accordance with aspects of the present invention, a screen printing machine is provided including a cabinet, a print screen, a platen assembly, and a curing assembly. The cabinet includes an upper opening and a shelf extending inwardly along at least two opposed cabinet sidewalls. The print screen is adapted to be held in a lateral position on the cabinet shelf The platen assembly is for supporting a substrate. The curing assembly is movably connected to the cabinet and located generally above the cabinet upper opening. The curing assembly includes a housing having an open bottom and at least one ultraviolet light element attached within the housing and oriented to direct ultraviolet light downward. During use, the curing assembly moves laterally between a first position in which the ultraviolet light element is not directly above the substrate and a second position in which the ultraviolet light element is located directly above the substrate.

In accordance with further aspects of this invention, one embodiment of a screen printing machine is provided in which the curing assembly is slidably engaged with the cabinet. The curing assembly includes a housing having a top wall, a carriage track attached to the underside of the top wall, a front wall, a back wall, side walls connecting between the front and back walls, an open bottom, and at least one ultraviolet light element attached within the housing and oriented to direct ultraviolet light downward. During use, the curing assembly translates laterally between a first position in which the ultraviolet light element is not directly above the substrate and a second position in which the ultraviolet light element is located near the housing front wall, the ultraviolet light element having translated across the housing along the carriage track and in doing so shining ultraviolet light on the substrate.

In accordance with other aspects of this invention, another embodiment of a screen printing machine is provided in which the curing assembly is rotatably coupled to the cabinet. The curing assembly includes a housing having an open bottom and at least one ultraviolet light element attached within the housing and oriented to direct ultraviolet light downward through the housing open bottom. The curing assembly is laterally rotatable between a first position in which the ultraviolet light element is not directly above the substrate and a second position in which the ultraviolet light element is directly above the substrate.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
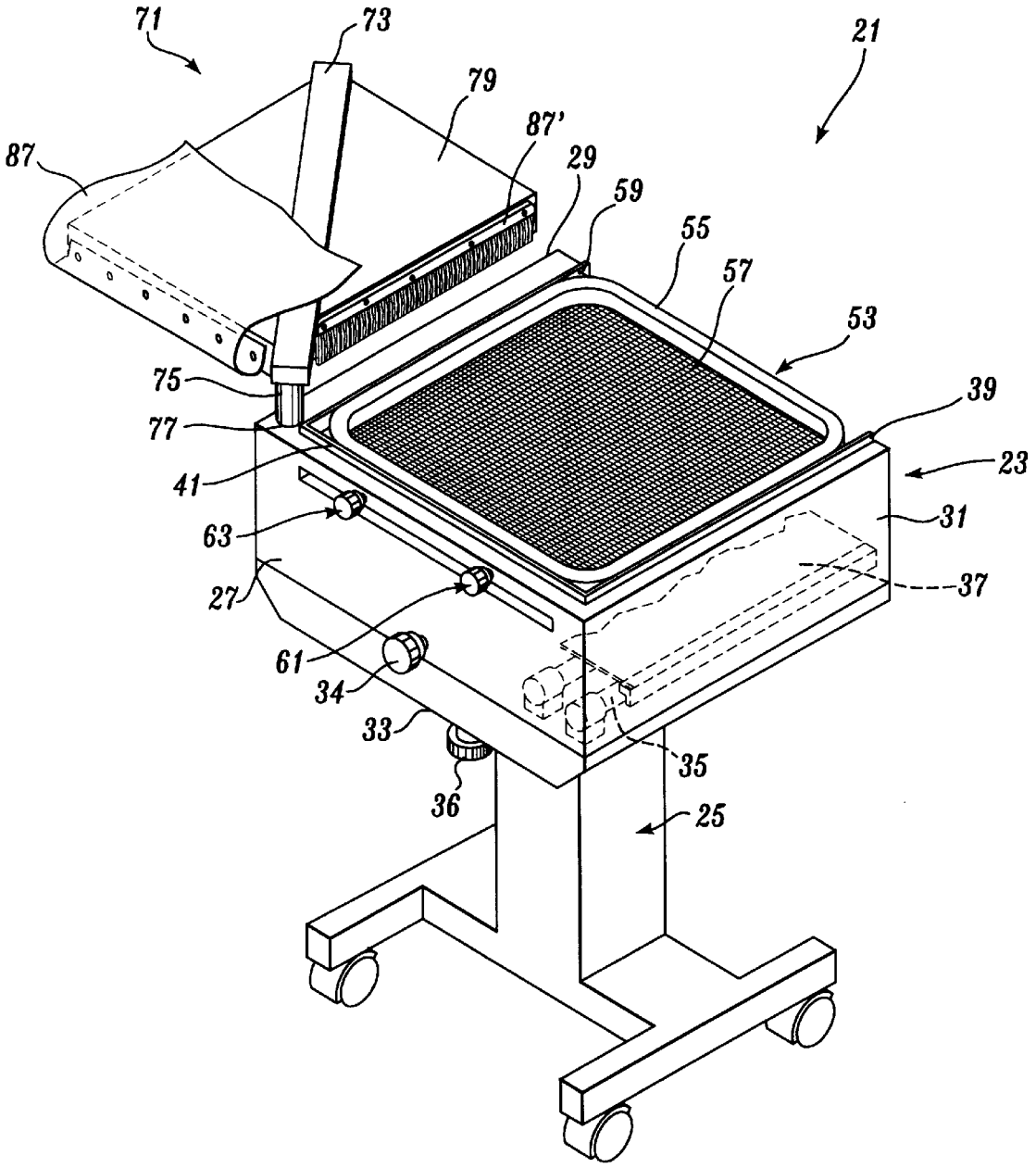
FIG. 1 is an isometric view of one embodiment of a screen printing machine formed in accordance with the present invention.
Figure 2:
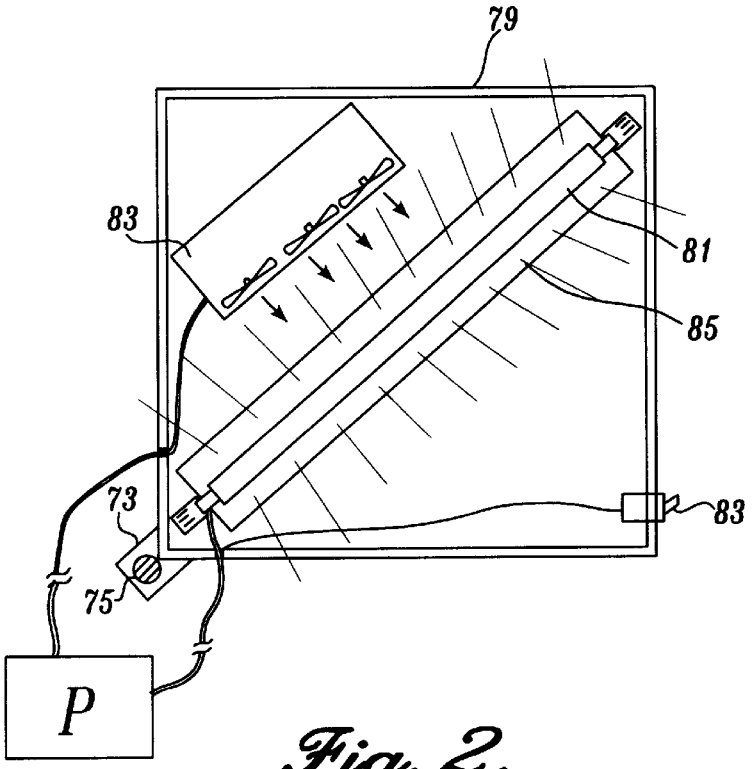
FIG. 2 is a plan view of the underside of one embodiment of a curing assembly for use in the machine of FIG. 1.
Figure 3:
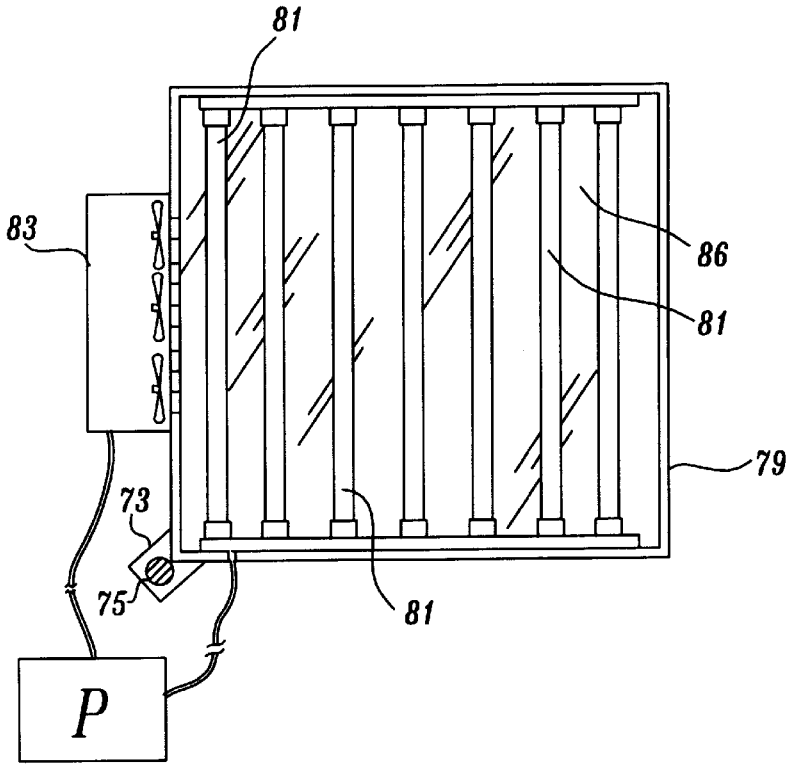
FIG. 3 is a plan view of the underside of another embodiment of a curing assembly for use in the machine of FIG. 1.

The present invention is an all-in-one screen printing machine that features an ultraviolet (UV) curing element. FIGS. 1–3 describe an embodiment of the present invention in which the UV curing element is provided in a housing that rotates laterally to a position directly above the substrate and rotates laterally to a position away from the substrate. FIGS. 4–8 describe another embodiment of the present invention in which the UV curing element is provided in a housing that slides laterally to a position directly above the substrate and slides laterally to a position away from the substrate.

Referring to FIGS. 1–3, there shown is one embodiment of a screen printing machine 21 formed in accordance with the present invention. The machine includes a number of features described in U.S. Pat. No. 5,622,108 and incorporated herein by reference.

In general, the machine includes a cabinet 23 mounted on a support stand 25. The cabinet 23 is defined by front, side, and bottom walls, 27, 29, 31, 33, respectively. The cabinet 23 has an open back and an open top. A plurality of lights 35 are provided at the bottom of the inside of the cabinet 23. The lights 35 are positioned to direct light upward. These lights may be any known type that are used to create the screen stencil, i.e., generally, any type that includes ultraviolet light. For example, white florescent lights contain some UV light and may therefore be used. The lights 35 are used as described below to create a print screen image. A horizontal cover plate 37 (shown in phantom in FIG. 1) is available to place over the lights 35 after the print screen is formed.

A pop-up screen holder 39 is supported by a lateral shelf formed in the cabinet near the cabinet upper opening. The holder 39 includes a horizontal U-shaped frame 41 and a vertical leg (not shown) that extends downward from one corner of the U-shaped frame 41. The vertical leg is rotatably engaged in the cabinet and is spring-loaded to move upward. The U-shaped frame 41 is sized to receive a print screen 53. The print screen 53 in FIG. 1 has a square shape and includes a frame 55 to which a fine mesh screen 57 is attached. The print screen frame 55 is sized to fit inside the U-shaped frame 41. A bevel block 59 connects to the U-shaped frame 41 and helps to maintain the print screen 53 in a fixed position within the U-shaped frame 41.

A latch mechanism (to which adjustment component 61 belongs) is provided to latch down the U-shaped frame 41 within the cabinet shelf during use. When the latch mechanism is released, the U-shaped frame 41 moves upward due to it being spring-loaded upward at its vertical leg. The U-shaped frame can then be rotated away from the cabinet 23 to allow a print to be observed, to move a curing assembly into position, or to remove or replace a substrate. The position of the U-shaped frame 41 and, thus, a print screen 53 mounted in the U-shaped frame is controlled by a screen registration mechanism (to which adjustment component 63 belongs.)

The screen printing machine 21 also includes a platen assembly (not shown in FIGS. 1 and 2) locatable within the cabinet. The platen assembly supports the substrate or object to be printed, such as a T-shirt or sweatshirt. A platen support and registration mechanism (to which adjustment components 34 and 36 belong) allows the operator to position the platen assembly in a particular orientation. The latch mechanism, the screen registration mechanism, the platen assembly, and the platen support and registration mechanism may be of the type described in U.S. Pat. No. 5,622,108.

As shown in FIG. 1, a curing assembly 71 is provided that includes an arm 73 having a downward extending leg 75 positioned to extend into a hole 77 formed in a cabinet upper corner. The curing assembly 71 as formed in accordance with the present invention includes a housing 79 within which a high-energy TV light element is provided to cure the ink. The housing 79 is laterally rotatable between a position in which the UV light element overlies the cabinet 23 and a position away from the cabinet 23. The latter position is illustrated in FIG. 1.

FIGS. 2 and 3 illustrate two different embodiments of a screen printing machine, each having a UV light element. Referring to the arrangement of FIG. 2, a single UV light bulb 81 is provided within the housing 79. The bulb 81 is oriented diagonally within the housing 79 and is powered by a source P. An optional electrical switch 83 may be used to provide direct control of the powering of the bulb. The arrangement of FIG. 3 includes multiple UV light bulbs 81 held crosswise within the housing 79. In general, the UV light bulbs 81 are arranged in a manner to provide the optimum light coverage over the intended substrate.

Because high-energy UV light bulbs have a tendency to become hot with use, a fan assembly 83 is preferably provided to blow ambient or cooled air across the bulbs 81. The arrangement of FIG. 2 includes a fan assembly 83 located within the housing itself The arrangement of FIG. 3 includes a fan assembly 83 attached to the exterior of a housing sidewall with air passages being formed in the housing sidewall to allow cool air to enter the housing and blow past the bulbs 81. Optional reflector 85 and/or heat resistant materials 86 may be positioned above or about the bulbs so as to deflect light and heat downward. The bulbs and fan assembly are normally always in an energized state.

In preferred embodiments, various protective flaps (e.g., items 87 and 87' in FIG. 1) are positionable about the housing exterior sides so as to further block UV light from reaching the worker. The flap 87 is a flexible opaque flap. The flap 87' is a strip having short flexible fringe extending therefrom. The flaps may be formed from various materials, including rubber, plastic, canvas, nylon, polyester, or the like. As will be appreciated, by shining the light straight downward and positioning the flaps about the housing, UV light is directed away from the worker. If additional safety precautions are desired, an independent switch may be used to control the timing of the curing UV light element. Such switch may be a simple on/off switch (such as switch 83.) In an alternative arrangement, the curing assembly may be arranged to trigger off whenever the housing is rotated away from the cabinet and to trigger on when the housing is rotated directly above the cabinet.

The screen printing machine 23 illustrated in FIGS. 1–3 and described above can be used to accomplish all major steps of screen printing, i.e., (i) to create an image-bearing screen; (ii) to use the image-bearing screen to create prints on suitable substrates; and (iii) to UV cure the print ink. To use the machine, an artwork image is first copied onto a film or translucent paper that passes UV light. The curing assembly 71 is rotated away from alignment with the cabinet 23. A work surface is created by placing a sheet of transparent material, such as glass or transparent plastic (which may form the cover 37 of the cabinet as well) in the U-shaped frame 41. The image-bearing UV paper is then placed on top of the glass plate in the desired position.

Next, a previously prepared print screen 53 is placed in the U-shaped frame 41, on top of the work surface and the image-bearing UV paper. The print screen 53 is prepared by coating its mesh 57 with a water-soluble photographic emulsion. After the coated print screen is placed on top of the work surface, the lights 35 are energized. Energization of the lights exposes and hardens the photographic emulsions in all screen areas except those areas covered by the image. After exposure, the print screen 53 is washed to remove the emulsion lying in the area covered or protected by the image. As a result, a print screen in the form of a stencil is created.

The work surface and the image-bearing UV paper are removed from the cabinet, and the cover 37 is installed over the lights 35 to protect them from ink and other debris. The U-shaped frame 41 is released from the cabinet 23 and the platen is installed. The substrate to be printed is placed on top of the platen and the U-shaped frame 41 and print screen 53 are positioned in the cabinet above the substrate. Ink is applied to the upper or ink side of the mesh 57. A squeegee is moved across the screen, forcing ink through the image apertures defined by the stencil image. As a result, an image is printed on the substrate.

After the design is printed, the print screen 53 is moved away from the substrate so that the substrate can be inspected to determine if the inking is complete. After the inking is complete, the ink is cured using the UV light element in the curing assembly 71. If multiple UV-cured colors are to be overlaid to create a multi-color design, each ink can be UV cured sequentially. UV curing is accomplished by rotating the housing 79 to a position where the energized UV light bulbs 81 overlie the substrate. The UV lights are allowed to shine on the substrate for a time sufficient to cure the ink. After curing, the curing assembly 71 is rotated away from the cabinet and the printed substrate is removed.

Figure 4:
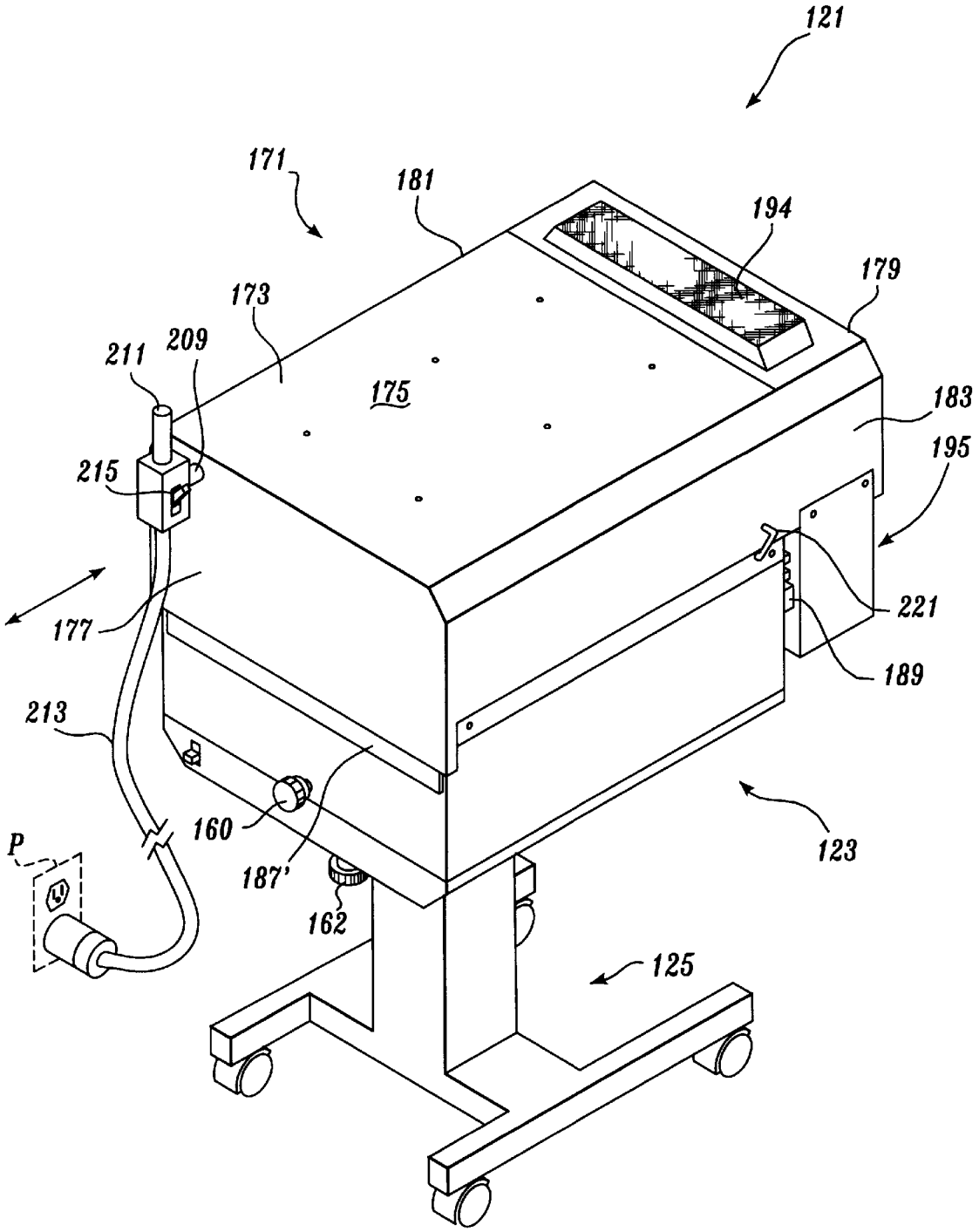
FIG. 4 is an isometric view of a second embodiment of a screen printing machine formed in accordance with the present invention, the machine being shown in a closed position.
Figure 5:
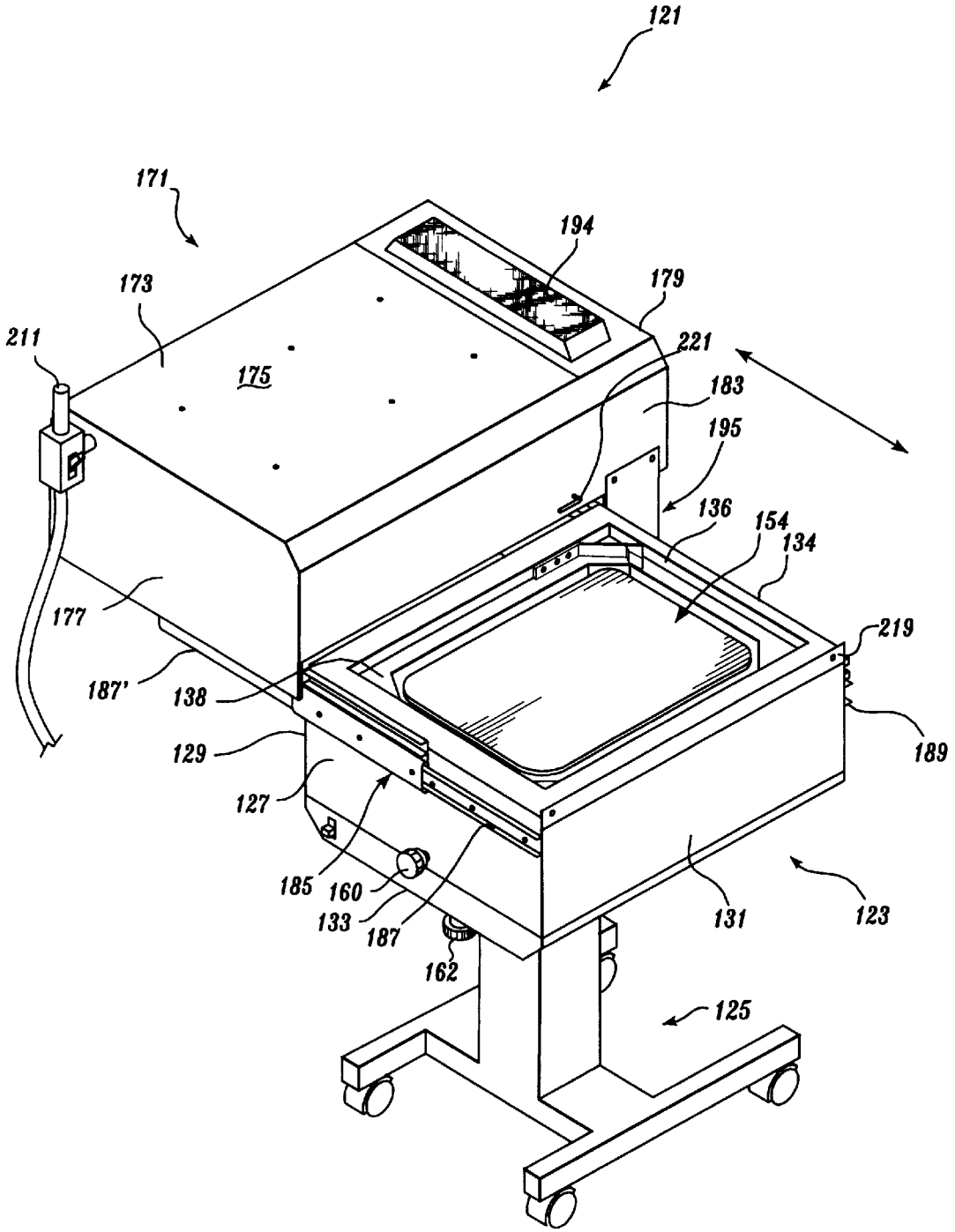
FIG. 5 is an isometric view the screen printing machine of FIG. 4, the machine being shown in an open position.
Figure 6:
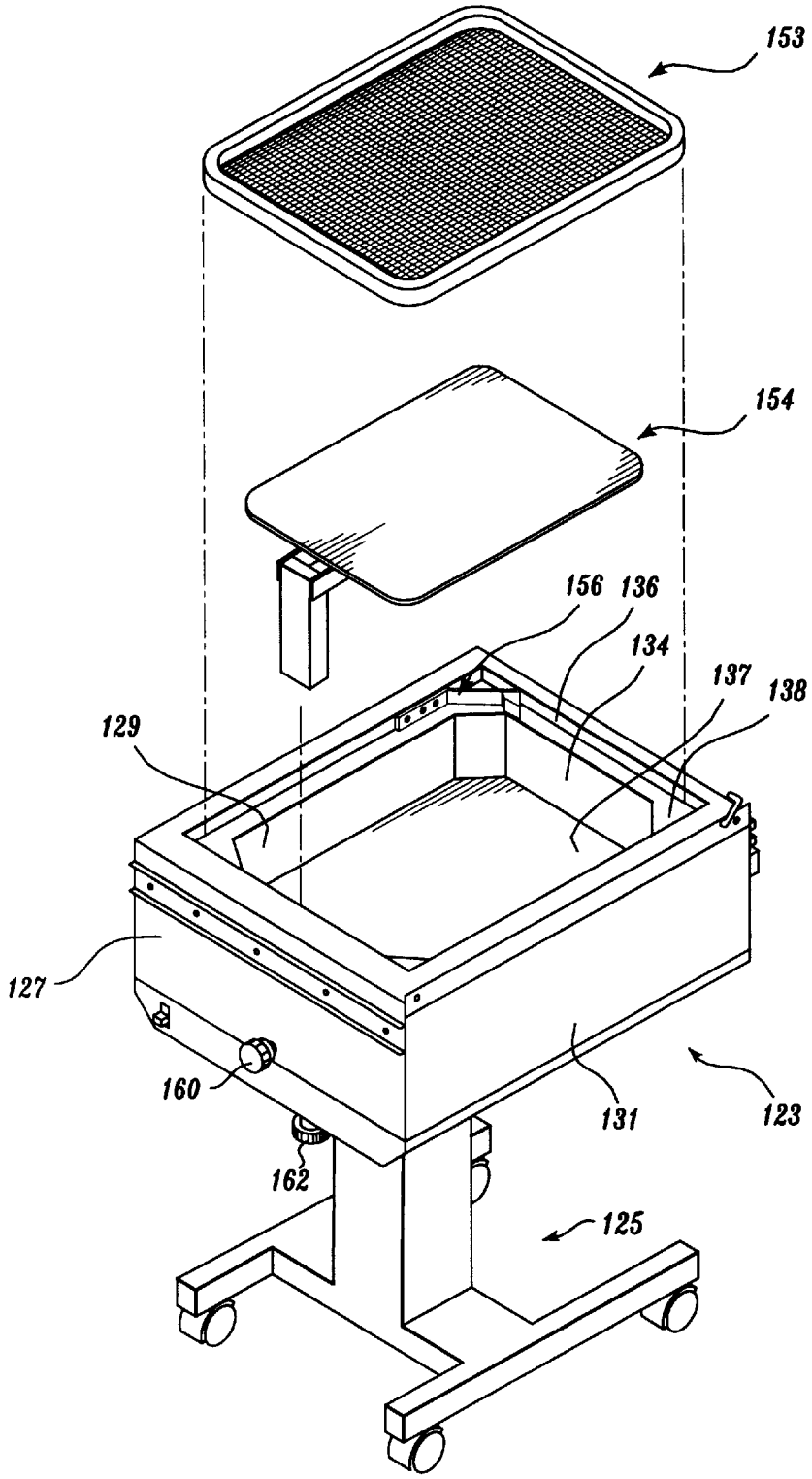
FIG. 6 is a partially exploded view of components of the screen printing machine of FIG. 4.

FIGS. 4–8 illustrate a second embodiment of a screen printing machine 121 formed in accordance with the present invention. FIG. 4 illustrates the machine 121 in a closed position. FIG. 5 illustrates the machine 121 in an open position.

Figure 7:
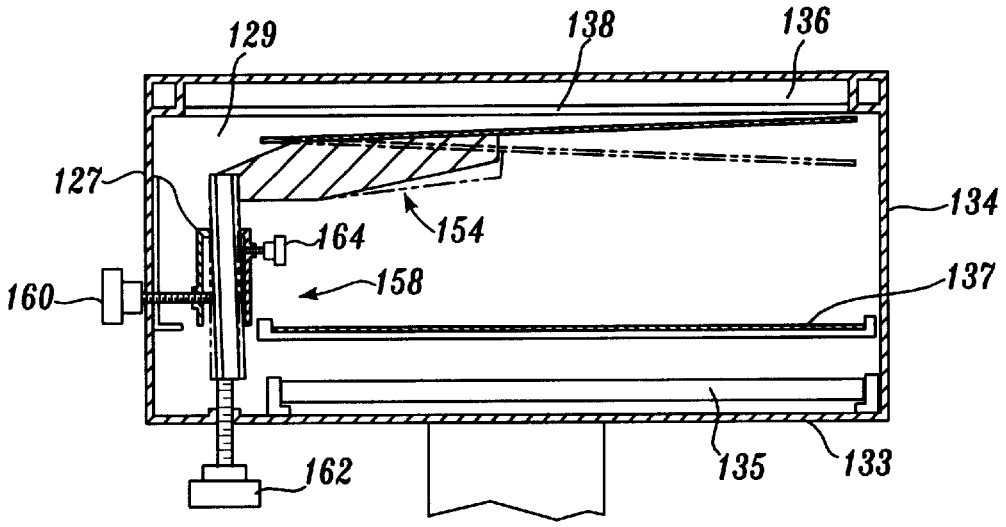
FIG. 7 is a cross-sectional view of components of the screen printing machine of FIG. 4.

Referring first to FIG. 5, the machine 121 includes a cabinet 123 mounted on a support stand 125. The cabinet 123 has a front wall 127, side walls 129 and 131, a bottom wall 133, and a back wall 134. Combined, the walls define an internal cabinet cavity. The cabinet has an open upper region 136. Referring to FIG. 7, a number of lights 135 are provided at the bottom of the cabinet cavity. The lights 135 are oriented to direct light upward. The lights 135 are used as described below to create a print screen image. A horizontal cover plate 137 is available to place over the lights 135 after the print screen stencil is formed.

Referring back to FIG. 6, a shelf 138 is formed in the cabinet near the cabinet upper region opening 136. The shelf 138 extends laterally inward a short distance from the cavity upright walls 127, 129, 131, 134 at a location slightly below the location of the cabinet upper opening 136. The shelf 138 is sized to receive a print screen 153. The screen printing machine 121 also includes a platen assembly 154 to support a substrate to be printed, such as a T-shirt or sweatshirt. A platen support mechanism 158 (shown in FIG. 7) allows the operator to position the platen assembly in a particular orientation using various adjustment knobs 160, 162, 164. The platen assembly 154 and the platen support mechanism are provided substantially similar to those described in U.S. Pat. No. 5,622,108. A registration system may be used as necessary to maintain the print screen in particular orientation. Various types of registration systems are known and may be used with the present invention screen printing machine with curing element. For example, the registration system and pop-up frame described in U.S. Pat. No. 5,622,108 may be used, or alternatively, the registration system 156 described below with reference to FIGS. 8–11.

Referring back to FIGS. 4 and 5, the screen printing machine 121 includes a curing assembly 171 that is connected to the cabinet 123 in a manner that allows an operator to slide the curing assembly 171 between open and closed positions. The 30 curing assembly includes a box-like housing 173 having a top wall 175, a front upright wall 177, a back upright wall 179, and opposed upright sidewalls 181, 183. The housing 173 is open on its under, or bottom, side. The connection between the housing 173 and the cabinet 123 in the embodiment of FIGS. 4–8 includes a track assembly 185 having guide rails 187, 189 attached to the cabinet front wall 127 and back wall 134, respectively. Mating track sleeves 187' and 189' are attached to the lower edges of the housing front and back walls 177, 179.

Figure 8C:
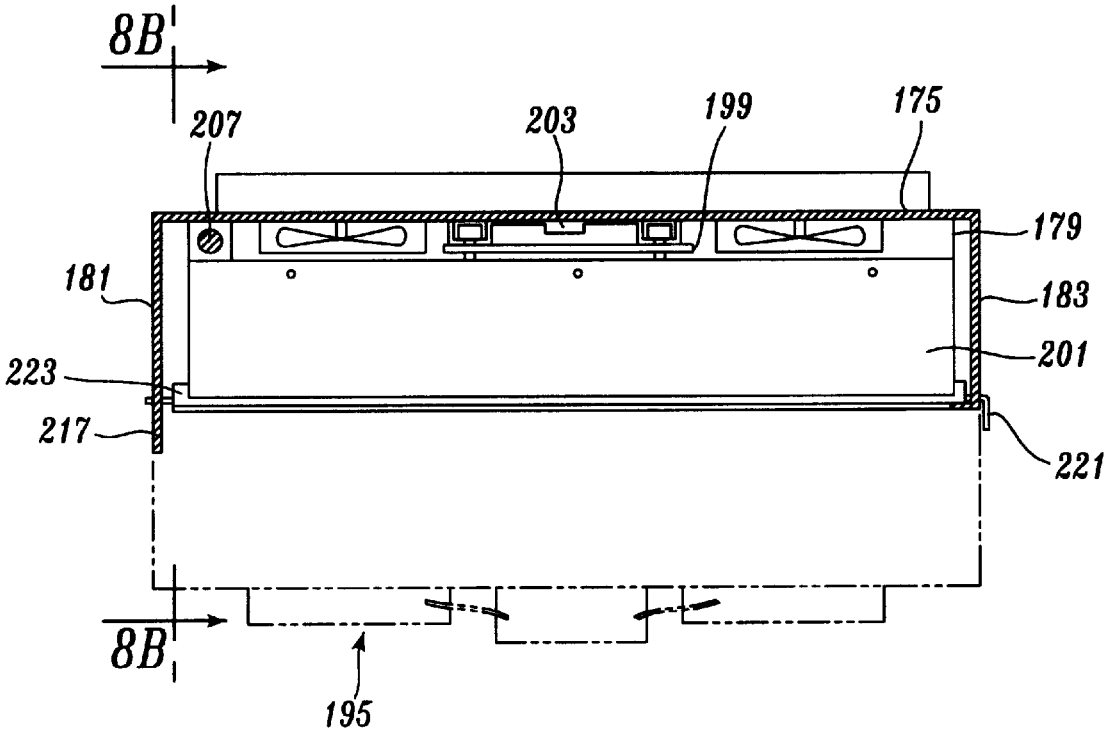
FIG. 8C is a cross-section side view taken along line 8C—8C of FIG. 8B.
Figure 8A:
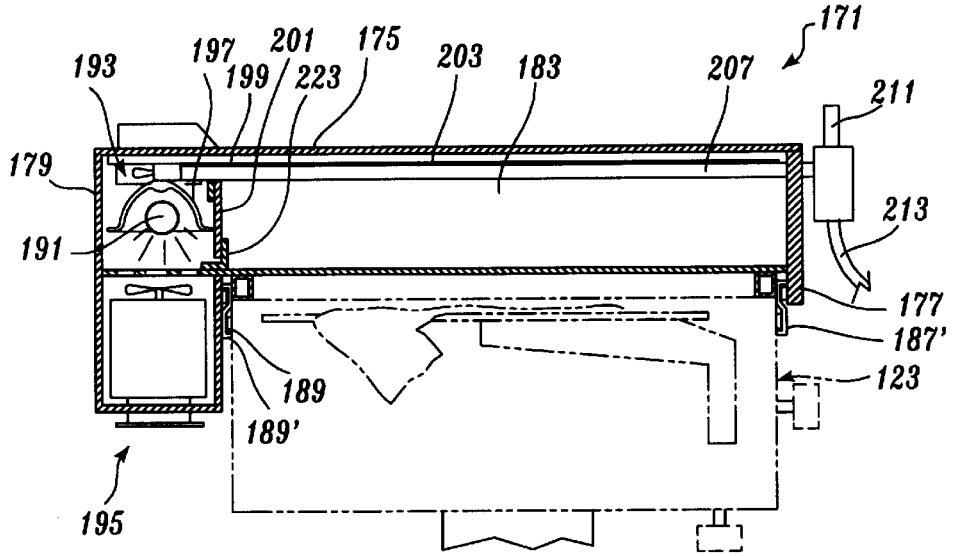
FIG. 8A is a side view of the curing assembly of the screen printing machine of FIG. 4, the curing assembly being shown in a storage position.
Figure 8B:
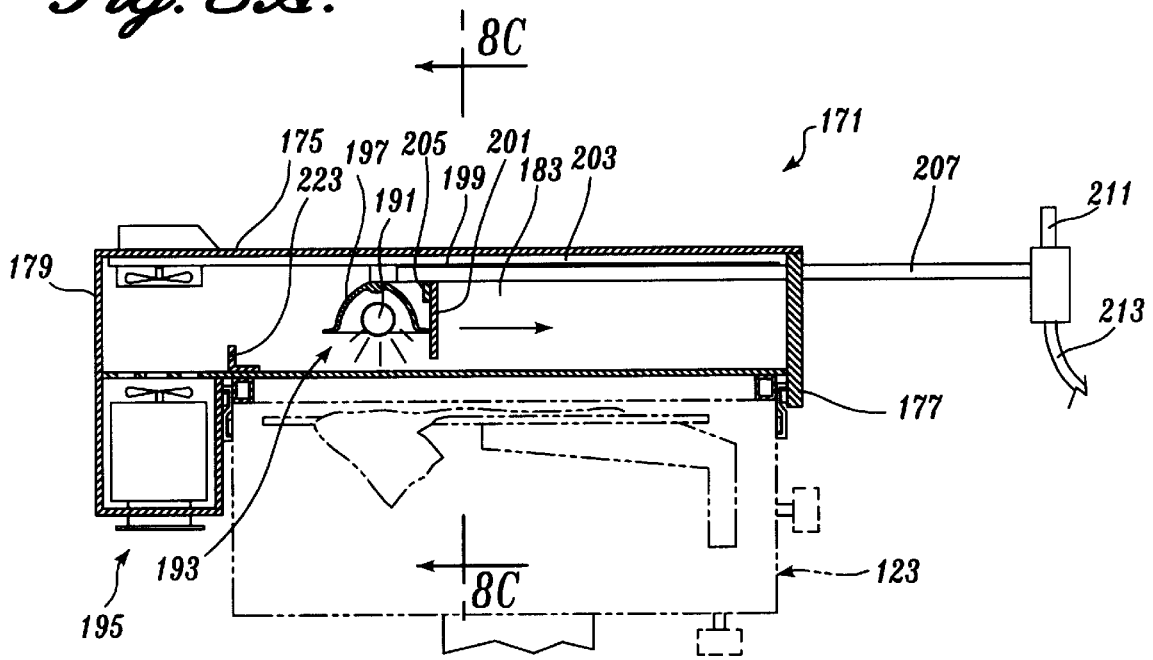
FIG. 8B is a side view of the curing assembly of the screen printing machine of FIG. 4, the curing assembly being shown in an operative position.

Referring to FIGS. 8A–8C, the curing assembly 171 further includes one or more high-energy UV light bulbs 191 housed in a movable bulb carriage 193. The carriage 193 is oriented laterally parallel to the housing front and back walls 177, 179. The carriage 193 is shown in FIG. 8A in a first or storage position in which the carriage 193 is located adjacent the housing back wall 179. The housing 173 is longer than the cabinet 123 so that the stored carriage 193 is substantially positioned outwardly past the location of the cabinet back wall 179. The housing 173 includes a fan assembly 195 connected across the housing back wall 179. The fan assembly 195 extends between the housing sidewalls 181, 183 at this location so that when looking up from beneath the housing, the movable bulb carriage 193 is not seen while it is in its stored position. In the embodiment of FIGS. 4–8, there are two lower fans positioned on the underside of the housing, and two upper fans positioned above the movable bulb carriage 193. The lower fans blow cool air onto the carriage, while the upper fans suction air out of the housing via a screen 194. Other cooling arrangements are possible.

Still referring to FIG. 8A, the movable bulb carriage 193 includes a downward facing reflector 197, a translatable roller carriage 199, and a shield plate 201. The translatable roller carriage 199 is attached to the top of the reflector 197 and is adapted to engage a carriage track 203 that is attached to the inside surface of the housing upper wall 175. The carriage track 203 extends the distance between the housing front and back walls 177, 179. The shield plate 201 is connected to the translatable roller carriage 199 and/or the reflector 197 via a mounting bracket 205. The shield plate 201 is positioned in an upright manner and is sized to help prevent UV light from escaping from the housing 173.

The curing assembly 171 further includes a lateral rod 207 connected at a distal end to the movable bulb carriage 193. The rod 207 extends out an opening 209 (see FIG. 4) in the housing front wall 177 and includes a handle 211 at a rod proximal end. The rod 207 is sized so that in the storage position, as shown in FIG. 8A, the rod handle 211 is near the housing front wall 177. During use, the rod handle 211 is pulled away from the housing front wall 177, as shown in FIG. 8B. When the rod handle 211 is pulled outward, the movable bulb carriage 193 moves likewise along the carriage track 203 attached to the housing upper wall 175. Similarly, when the rod handle 211 is pushed toward the housing front wall 177, the movable bulb carriage 193 moves likewise backward along the carriage track 203. In this way, the movable bulb carriage 193 is translated back and forth between a storage position at the housing back wall 179 and a second, or extended, position in which the movable bulb carriage 193 is adjacent to the housing front wall 177.

The UV light bulb 191 is powered by an external power source P through wiring 213 extending through the rod 207. The UV light bulb is preferably kept in an energized state. An optional switch 215 (shown in FIG. 4) may be used to provide direct control of the powering of the bulb 191. Because high-energy UV light bulbs have a tendency to become hot with use, the fan assembly 195 is provided to blow ambient or cooled air across the bulbs. The fan assembly is also preferably kept running at all times. During use, it is suggested to turn the fan assembly on prior to energizing the bulbs 191; and keeping the fan assembly on for a period of time even after the bulbs have been turned off. This helps to keep the UV bulbs cool.

A number of additional safety features are preferably used with the arrangement of FIGS. 4–8. In particular, the curing assembly housing distal side wall 181 is preferably extended downward a short distance (see FIG. 8C, item 217) so that when the curing assembly 171 is in an operative position, the extended portion 217 will overlap with the cabinet sidewall 129. This helps to prohibit UV light from shining out from under the curing assembly housing 173. In addition, the cabinet sidewall 131 is preferably extended upward for the same reason. See FIG. 5, item 219.

Referring to FIG. 4, a safety latch 221 is provided that rotates between a down position and an up position (shown in FIG. 5). Referring to FIGS. 8A–8C, the latch 221 is connected to an elongated member 223 having an L-shaped cross-section. The elongated member 223 extends between the housing side walls 181, 183 at a location near the fan assembly 195. Referring to FIG. 8A, when the movable bulb carriage 193 is located in its stored position, the elongated member 223 is in an up position, and is oriented with one leg positioned horizontally and the orthogonal leg positioned vertically and forward of the shield plate 201. In this up position, the latch 221 is clear of the cabinet side wall 131 and extension 219 and therefore is not conflicted should the operator attempt to slide the curing assembly 171 laterally away from the cabinet upper opening 136.

When the operator has positioned the curing assembly 171 directly above the cabinet, the operator pulls the handle 211 to translate the movable bulb carriage 193. This causes the shield plate 201 to push the vertical leg of the elongated member and thereby rotate the member 223 to a down position. In the down position, the previously horizontal leg is now vertical and the previously vertical leg is now horizontal. The vertical leg is positioned aft of the shield plate 201 so that the plate 201 and the movable bulb carriage 193 are free to translate forward. The vertical leg and the movable bulb carriage 193 are sized and positioned so that they will not conflict as the carriage moves over the elongated member during the carriage's forward translation. In the down position, the latch 221 is rotated downward also, as shown in FIG. 4. When the latch is down, it will conflict with the cabinet side wall 131 and extension 219 so as to prohibit the operator from sliding the curing assembly away from the cabinet. When the movable bulb carriage 193 is pushed back to its stored position, the shield plate 201 rotates the member 223 back to its original up position and the latch back to its up position, thereby allowing the operator to slide the curing assembly away from the cabinet.

To use the screen printing machine 121 of FIGS. 4–8, an artwork image is first copied onto a film or translucent paper that passes UV light. The curing assembly 171 is slid away from the cabinet 123. A work surface is created by placing a sheet of transparent material, such as glass or transparent plastic (which may form the cover 137 of the cabinet as well) on the shelf 136. The image-bearing UV paper is then placed on top of the glass plate in the desired position.

Next, a previously prepared print screen 153 is placed on top of the work surface and the image-bearing UV paper. The print screen is prepared by coating the mesh with a water-soluble photographic emulsion. After the coated screen is positioned, the lights 135 are energized. Energization of the lights exposes and hardens the photographic emulsions in all print screen areas except the areas covered by the image. After exposure, the print screen 153 is removed from the cabinet 123 and washed to remove emulsion in the areas covered by the UV paper image. As a result, a print screen in the form of a stencil is created.

The work surface and the image-bearing UV paper are removed from the cabinet 123 and the cover 137 is installed over the lights 135 to protect them from ink and other debris. The platen assembly 154 is installed. The substrate to be printed is placed on the platen assembly 154 and the print screen 153 is repositioned in the cabinet above the substrate. Adjustments are made as necessary to the substrate, the platen assembly, and the print screen. Ink is applied to the upper side of the print screen. A squeegee is moved across the print screen to force ink through the image apertures defined by the stencil image. As a result, an image is printed on the underlying substrate.

After the design is printed, the screen print 153 is moved away from the substrate and the ink is cured using the curing assembly 171. If multiple colors are to be overlaid to create a multi-color design, each ink can be UV cured sequentially. UV curing is accomplished by sliding the housing 173 to a position directly over the cabinet 123, and hence, directly over the substrate. The operator then moves the handle 211 so that the movable bulb carriage 193 is translated the length of the carriage track 203 and back. This allows the UV light bulbs 191 to shine on the substrate for a time sufficient to cure the ink. After returning the movable bulb carriage 193 to its stored position, the curing assembly 171 is slid away from the cabinet 123 and the printed substrate is removed.

As will be appreciated from a reading of the above, a screen printing machine formed in accordance with this invention is an all-in-one machine that can be configured to carry out the major steps required to take advantage of recent screen printing techniques—creating an image-bearing print screen, using the screen to print a design on a garment, and curing the ink using an UV curing light source. The present invention accomplishes these steps in a manner that allows the substrate to remain in a single location. This reduces errors in printing and reduces the total time necessary to screen a substrate object, particularly when doing multiple color printings.

Figure 9:
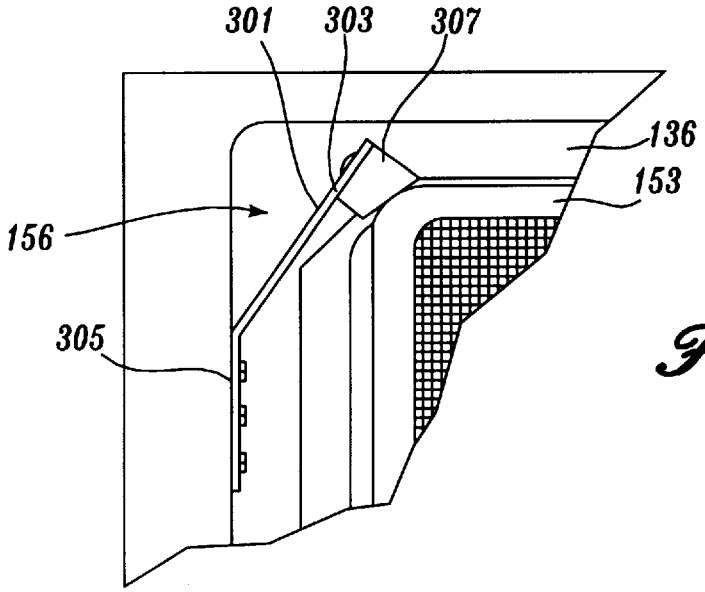
FIG. 9 is a plan view of a registration element.

FIG. 9 shows a detail view of a registration system 156 in which a registration flex arm 301 is provided in one corner of the cabinet shelf 136. The flex arm is a type of spring formed of a slightly bendable metal or rigid plastic. The arm is elongated and includes two portions—a movable portion 303 and an attachment portion 305—that connect to form an elbow. The inside angle of the elbow is in the range of about 170 degrees to about 100 degrees, one amount being about 135 degrees. The attachment portion 305 is attached to an upright side wall of a cabinet (e.g., cabinet 23 or cabinet 123). The movable portion 303 extends laterally into the cabinet. The movable portion 303 includes an inwardly-facing padded portion 307. During use, a print screen is held between the padded portion 307 and the opposed cabinet shelf corner. The spring arm 301 provides an inward force to the frame that is generally directed diagonally, i.e., toward the cabinet's opposite shelf corner.

To use the registration system 156, the operator must first place the screen (or screen holder as the case may be) at the cabinet shelf. The operator then moves the flex arm movable portion 303 toward the adjacent cabinet side wall a distance sufficient to allow the screen to drop onto the cabinet shelf. The movable portion 303 is then released thereby causing it to spring back to its original configuration, and in doing so, to push the screen toward the opposite cabinet shelf corner. This causes the screen to be held securely between the flex arm 301 and the opposite cabinet shelf corner. The reverse procedure is used to release the screen.

Figure 10:
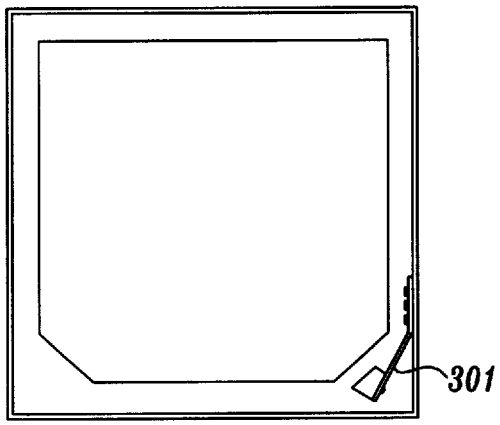
FIG. 10 is a plan view of the registration element of FIG. 9 as applied to one embodiment of the present invention screen printing machine with UV curing element and FIG. 11 is a plan view of the registration element of FIG. 9 as applied to an alternative embodiment of the present invention screen printing machine with UV curing element.
Figure 11:
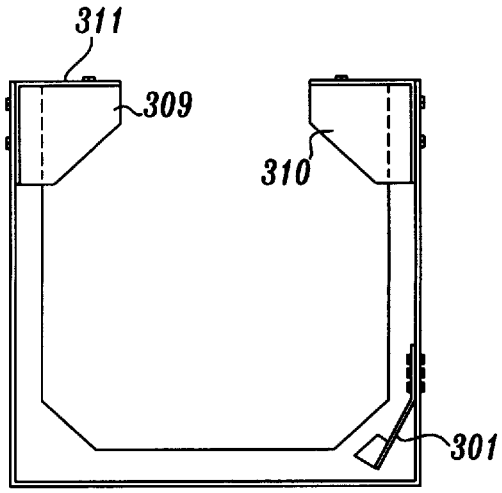

FIG. 10 shows one arrangement of the flex arm 301 as applied to a screen printing machine having a cabinet with four upright sidewalls. FIG. 11 shows an alternative arrangement of the flex arm 301 as applied to the screen printing machine having only three upright sidewalls. The cabinet is modified to include a shelf corner piece 309 attached to the opposite side wall. The corner piece 309 includes a front upright fence 311 that extends only partially toward the opposite side wall. The attachment may be secured to the shelf and/or the side wall, or may be integrally formed therewith. A similar corner piece 310 may be used on the opposite open comer as needed to stop rotation or other movement of the print screen. Either arrangement of FIGS. 10 and 11 may be used with either present invention print screening machine embodiment shown in FIGS. 1–3 or FIGS. 4–8.

While the preferred embodiment of the invention has been illustrated and described, it will be appreciated that various changes can be made therein without departing from the spirit and scope of the invention.

What ids claimed is:

1. A screen printing machine comprising:

(a) a cabinet having an upper opening and a shelf extending inwardly along at least two opposed cabinet sidewalls;

(b) a print screen adapted to be held in a lateral position on the cabinet shelf;

(c) a platen assembly for supporting a substrate, the platen assembly being provided within the cabinet near the upper opening; and (d) a curing assembly movably connected to the cabinet and located generally above the cabinet upper opening, the curing assembly including a housing having an open bottom and at least one ultraviolet light element attached within the housing and oriented to direct ultraviolet light downward;

wherein during use, the curing assembly moves laterally between a first position in which the ultraviolet light element is located away from the substrate and a second position in which the ultraviolet light element is located above the substrate; and wherein the curing assembly is slidably engaged with the cabinet;

the curing assembly including a housing having a top wall, a front wall, a back wall, side walls connecting between the front and back walls, an open bottom, the curing assembly also including a carriage track attached to the underside of the housing top wall, a movable carriage, and at least one ultraviolet light element attached to the movable carriage within the housing and oriented to direct ultraviolet light downward;

during use, the curing assembly translates laterally to positions away from and above the cabinet; the movable carriage also translating between a first carriage position in which the ultraviolet light element is located near the housing back wall and a second carriage position in which the ultraviolet light element is located near the housing front wall, the ultraviolet light element having translated across the housing along the carriage track and in doing so shining ultraviolet light on the substrate.

2. The screen printing machine of claim 1, wherein the curing assembly includes one or more fan assemblies to cool the ultraviolet light element.

3. The screen printing machine of claim 2, wherein the at least one ultraviolet light element includes a plurality of ultraviolet light bulbs.

4. The screen printing machine of claim 1, wherein the movable carriage further includes a light reflective material positioned above the at least one ultraviolet light element to assist in directing light downward.

5. The screen printing machine of claim 1, wherein the movable carriage is a rigid reflector.

6. The screen printing machine of claim 1, wherein the curing assembly further includes a heat resistant and heat reflective material positioned above the at least one ultraviolet light element.

7. The screen printing machine of claim 1, wherein the curing assembly further includes an upright shield plate located adjacent the ultraviolet light element to help block ultraviolet light from view.

8. The screen printing machine of claim 1, wherein the curing assembly further includes a handle connected to the movable carriage, the handle allowing an operator to manually move the movable carnage and ultraviolet light element between the first and second carriage positions.

9. The screen printing machine of claim 1, wherein upon providing power to the machine, the ultraviolet light element is kept in an energized state.

10. The screen printing machine of claim 1, wherein the curing assembly further includes a control switch to manually turn the at least one ultraviolet light element on and off.

11. The screen printing machine of claim 1, further comprising a safety latch connected to the curing assembly, the safety latch hang a locked position in which the curing assembly is prohibited from translating away from the cabinet and an unlocked position in which the curing assembly is not prohibited from translating away from the cabinet.

12. The screen printing machine of claim 11, wherein the curing assembly includes a handle connected to the movable carriage, the handle allowing an operator to manually move the movable carriage and ultraviolet light element between the first and second carriage positions; and further wherein the safety latch is connected to the handle, the safety latch being locked when the handle is not in a retracted position.

* * * * *

UNITED STATES PATENT AND TRADEMARK OFFICE

CERTIFICATE OF CORRECTION

PATENT NO. : 6,155,170
DATED : December 5, 2000
INVENTOR(S) : J.R. Benedetto et al.

It is certified that error appears in the above-identified patent and that said Letters Patent is hereby corrected as shown below:

Column 1,
[73] Assignee after "Wash." insert --and NAMCO, Inc., Kirkland, Wash.--

Column 12,
Line 2, "carnage" should read --carriage--

Signed and Sealed this

Fourteenth Day of August, 2001

*Attest:*

Nicholas P. Godici

*Attesting Officer*

NICHOLAS P. GODICI
*Acting Director of the United States Patent and Trademark Office*